US006605008B1

(12) United States Patent
Kovarik

(10) Patent No.: US 6,605,008 B1
(45) Date of Patent: Aug. 12, 2003

(54) GOLF CLUB

(76) Inventor: Tibor F. Kovarik, 36 Lloydminster Crescent, Toronto, Ontario (CA), M2M 2R8

( * ) Notice: Subject to any disclaimer, the term of this patent is extended or adjusted under 35 U.S.C. 154(b) by 0 days.

(21) Appl. No.: 09/664,370

(22) Filed: Sep. 18, 2000

(51) Int. Cl.[7] ..... A63B 53/04
(52) U.S. Cl. ..... 473/329; 473/313; 473/251
(58) Field of Search ..... 473/329, 345, 473/350, 340, 341, 313, 314, 328, 344, 349, 338, 251, 252

(56) References Cited

U.S. PATENT DOCUMENTS

D188,857 S * 9/1960 Mospan
3,516,674 A * 6/1970 Scarborough
3,841,640 A * 10/1974 Gaulocher
4,871,174 A * 10/1989 Kobayashi
5,294,122 A * 3/1994 Longo
5,676,606 A * 10/1997 Schaeffer et al.
5,749,791 A * 5/1998 Passeri, Jr.
5,820,481 A * 10/1998 Raudman
5,913,731 A * 6/1999 Westerman
6,126,556 A * 10/2000 Hsieh
6,267,689 B1 * 7/2001 Ambrose
6,319,146 B1 * 11/2001 Mills

* cited by examiner

*Primary Examiner*—Paul T. Sewell
*Assistant Examiner*—Nini F. Legesse

(57) ABSTRACT

A golf club such as a putter and having a club body defining a main portion and two side portions extending forwardly of the main portion, with the side portions defining a space between them, a striking face made of a metallic beam, each end of the beam being supported in respective side portions of the club body, in which the length of the beam between the two ends extends across the space and is unsupported.

14 Claims, 5 Drawing Sheets

GOLF CLUB

FIELD OF THE INVENTION

This invention relates to a golf club, and more particularly to a golf club known as a putter, in which the striking face of the putter is formed by a metallic beam, supported at each end but unsupported between its ends.

BACKGROUND OF THE INVENTION

Putting is a major part of the game of golf. It is known that most putters must strike the ball at the dead centre of the "sweet spot" of the striking face, in order to achieve maximum accuracy. Blade putters have been designed with the shaft centered on the face. In theory when the ball is struck dead Centre, with this kind of putter, there will be no torsional moment. However it is seldom that the average player can reach such a degree of perfection. Usually the ball is slightly off Centre on the face, and this causes twisting of the shaft. Weighting of the club head enhances its performance when striking the ball over a long distance. Applying weight in specific locations of the head improves club stability by keeping the swing path constant as well as providing greater resistance against rotation upon striking the ball at a location other than on the sweet spot. Conventional putters are at a disadvantage, due to their very small sweet spot, on which it is difficult to contact the ball accurately upon swinging the club. The sweet spot is the area of the club face where the impact force is balanced by the weight of the club head ,and club head rotation is thus reduced as close as possible to zero, thus eliminating torsional force from being transmitted through the head, the shaft and finally to the hands of the player. This area is also known as the putter's Centre of percussion. Striking the club face outside the sweet spot imparts a torsional force thus robbing the club of the desired energy for propelling the ball towards the target. Hitting the ball outside the sweet spot also reduces directional accuracy in reaching the intended target.

Another factor is that the design of most putters attempts to make the striking face as rigid as possible, in the hope that this will increase accuracy. In fact however it produces the reverse effect. It is surprisingly found that the more rigid the face the greater the rebound characteristics and there is a tendency for the ball to be deflected away from its intended path, when it is hit off Centre on the face.

SUMMARY OF THE INVENTION

In accordance with the present invention the putter is provided with a striking face made of a metallic beam, usually a bronze blade. Each end of the beam is supported, in a club body, but the length of the beam between the two ends is unsupported. This enables the beam to behave with the engineering characteristics of a true beam. It is known that a beam in an engineered structure will flex between the two ends, where it is unsupported. The design of structures is calculated to allow for such flexing, and in fact this is an inherent quality of a beam and the degree of flexing can be calculated and allowed for. When these principles are applied, in accordance with the invention to the construction of the striking face of a putter, it will be seen that even though short, the unsupported central part of the beam will flex, upon impact with the ball. This flexing tends to give greater control to the direction of the path of the ball. Even when the ball is struck off Centre along the beam, the fact that the beam flexes, even though only slightly, will tend to direct the ball along its intended path. It also tends to reduce torsional forces by distributing the impact load to each end of the beam to be absorbed by the head. These torsional forces would otherwise tend to twist the handle in the hands of the player, sending the ball off course.

Preferably the beam is set at its two ends in metal epoxy.

The club head is designed with a crescent shaped head, typically of wood. A cavity is formed at the end of each of the crescent shaped arms. The ends of the beam are received in respective cavities, and embedded in synthetic bonding material, preferably epoxy material.

Preferably the club head is attached to a shaft formed with a double offset bend. This has the effect of lining up the axis of the shaft with the front face of the putter. Preferably the crescent shape of the club head defines a generally triangular recess or space between the back face of the beam or blade and the head. The head thus becomes in effect a sort of sounding box when the ball is struck. When the ball is struck it develops a distinctive sound. The closer the ball struck to the sweet spot, the truer the sound produced. This particular feature provides the player an audible indication when the ball has been struck at the optimum location on the blade. It is widely known that a player should keep his eyes on the ball and not look up until the ball almost reaches the hole. Utilizing the sense of sound in this fashion without looking up, provides the player with an additional advantage.

This invention also employs a unique means of blade support, which is different from the traditional putters available today. In the case of other mallet head type putters, their blade or their striking surface is embedded into or forms an integral part of the putter head where the blade may be of the same material as the rest of the head. In the case of a solid putter head, the face may become rigid and unable to resonate. In the case of those clubs where the blade is homogeneous with the head at the ends, the blade tends to behave like a fully fixed beam having a natural frequency based on material, thickness and length of the supported blade.

In the present invention, the blade is formed of metal approximately 0.25 inch thick, usually bronze, having ends which are embedded in a metal epoxy mixture in cavities at each end of the crescent shaped wooden club body. Other materials for the head may also be employed yielding similar performance results. This means of supporting the blade will change the degree of fixity to that of a semi-fixed beam and will change the natural frequency of the blade giving a better feel to the player when striking the ball. It will also provide less of a shock to the hands in the event of a miss hit.

The present invention uses a brass plate sole to provide weight at the bottom of the head thereby lowering the center of gravity for optimized blade to ball contact. The lowered center of gravity thus provides maximum swing arc energy to the ball at club impact. It also prevents ball skip for the long distance shots across the green, which is a common problem with other putters. The combination of the bronze blade, brass sole and hardwood head, in terms of weight, provides improved anti-rotation features over other conventional clubs mainly because of the large concentration of weight behind the face of the blade. This gives a solid feel to the player for long distance puts where more mass resistance is required at time of impact.

The constant depth blade provides a generous sweet spot for the average player who is likely to miss the ideal location on the face. The blade is positioned above the sole of the club to prevent it from digging into the playing surface as the club moves through the swing arc. Angular profile is provided to the bottom surface of the head to cater to various ground clearance conditions and player's personal preferences for holding the club.

Preferably the top of the head is flat and parallel with the sole. This provides a visual reference to the player of the club's alignment with the playing surface. In this way the player can ensure that the ball is struck perpendicularly to the face of the blade thus sending the ball true to the target.

Preferably a ball to target visual alignment feature is provided by a set of sight lines extending from across the top surface of the blade to the top surface of the head in the form of a linear groove. These sight lines, due to the size and extent of the top surface of the club, are of greater length than sight lines on conventional putters giving the player an extra advantage. When utilized properly, and the sight groove aligned to the target, the ball upon striking will be sent in a direction that is perpendicular to the face of the blade thus providing the desired results.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
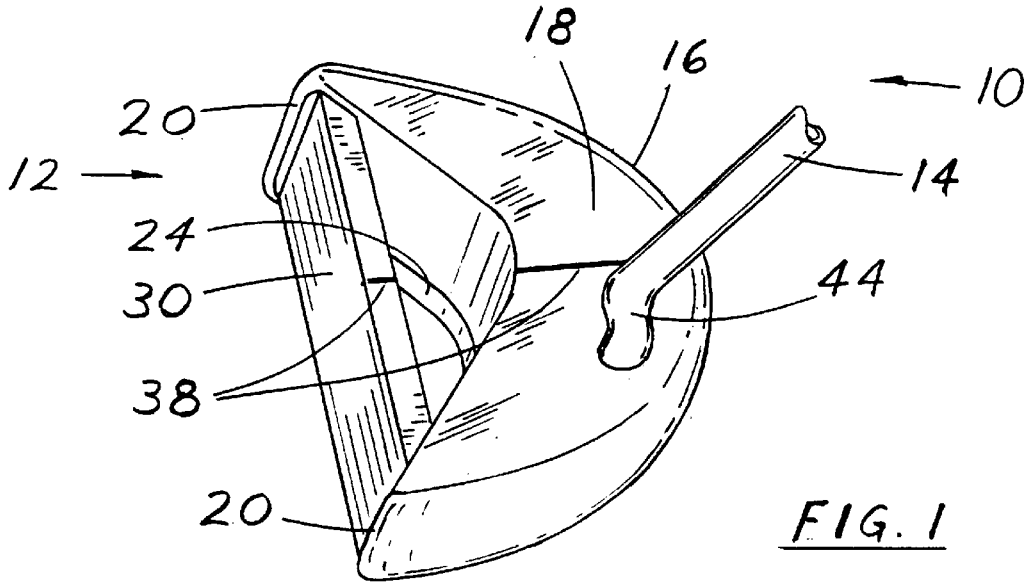
FIG. 1 is a upper perspective illustration of a golf club, in this case a putter, illustrating the invention.
Figure 2:
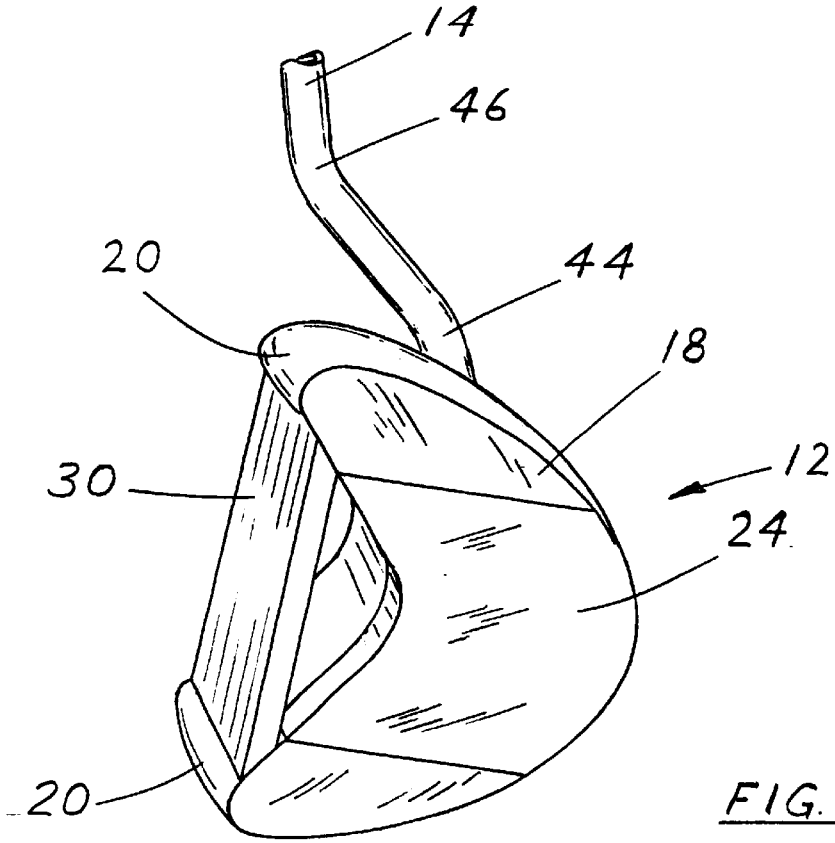
FIG. 2 is a lower perspective of the golf club of FIG. 1.

Referring first of all to FIG. 1 and FIG. 2, it will be apparent that the invention is illustrated here in the form of a putter. The uses of a putter are too well known to require further description. It should be understood however that the principles of the invention are applicable, with appropriate modifications, to both drivers, and to irons.

The club is shown generally as 10 and comprises a head 12 and a shaft 14. The head 12 in turn comprises a body 16 which is usually although not exclusively made of wood. Wood has an aesthetic appeal to players, but solid metallic heads can also be used. Wood is also advantageous for other reasons as explained below, in that it assists in providing a distinctive ringing sound when the ball is struck. The body 16 is of generally crescent shape in plan and defines a main portion 18 and two side arm portions 20 extending forwardly. Between the two arm portions 20 there is a recess or space 22 formed for reasons described below.

The underside of the body 16 is weighted with a metallic sole plate 24 usually made of brass.

Figure 7:
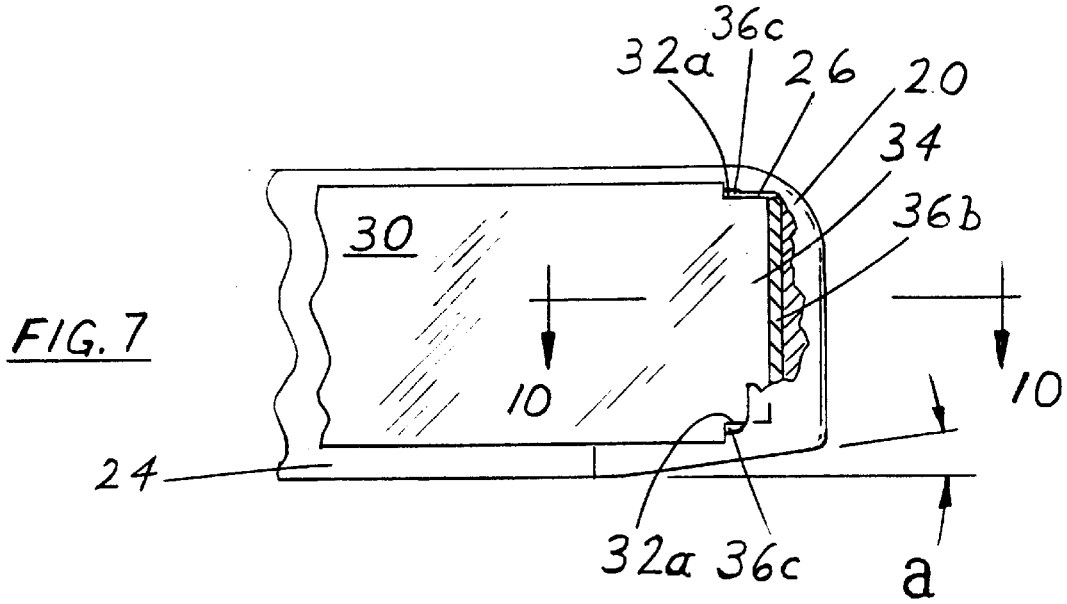
FIG. 7 is a partial front elevation of the club face with portions cut away.
Figure 8:
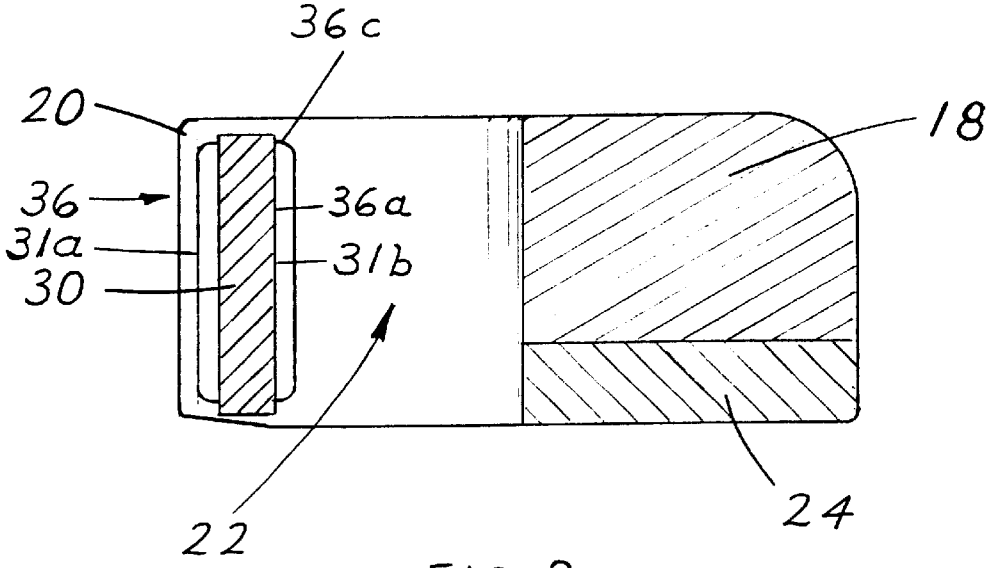
FIG. 8 is a section along the line 8—8 of FIG. 3.
Figure 9:
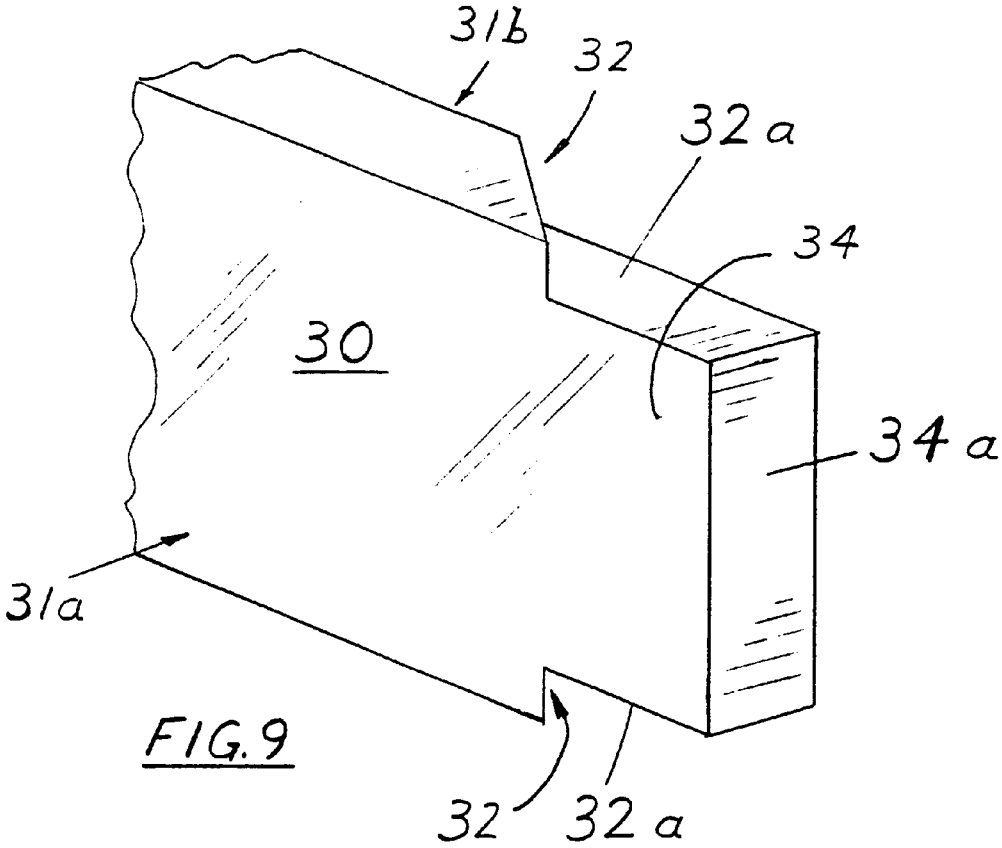
FIG. 9 is an enlarged perspective of one end of the metallic beam.

On either side of the plate 24 the undersurface of body 16 is bevelled upwardly. The angle "a"(FIG. 7), of the bevel is preferably about 15 deg, on either side, from the planar undersurface of the club. This feature enable players to adopt a variety of stances when addressing the ball, without the edge of the body 16 striking the playing surface.

At the two forward free ends of the arm portions 20 there are formed cavities 26 and 26 for reasons described below.

The striking face of the club is formed by a metallic beam 30. Beam 30 is a flat planar bar of suitable metal. Bronze is especially suitable. Beam 30 defines parallel front and back surfaces 31*a* and 31*b*, and is of regular thickness along its length, from end to end. Beam 30 is of generally rectangular shape in elevation and has upper and lower notches 32 formed in the upper and lower edges of the beam 30, at either end defining reduced width ends 34—34, at each end of the beam 30. The beam in the region of the reduced width notches 34 has top and bottom edge surfaces 32*a*–32*b*, and has end edge surfaces 34*a*.

The ends 34 of beam 30 are received in respective cavities 26 and 26 of arms 20.

Figure 10:
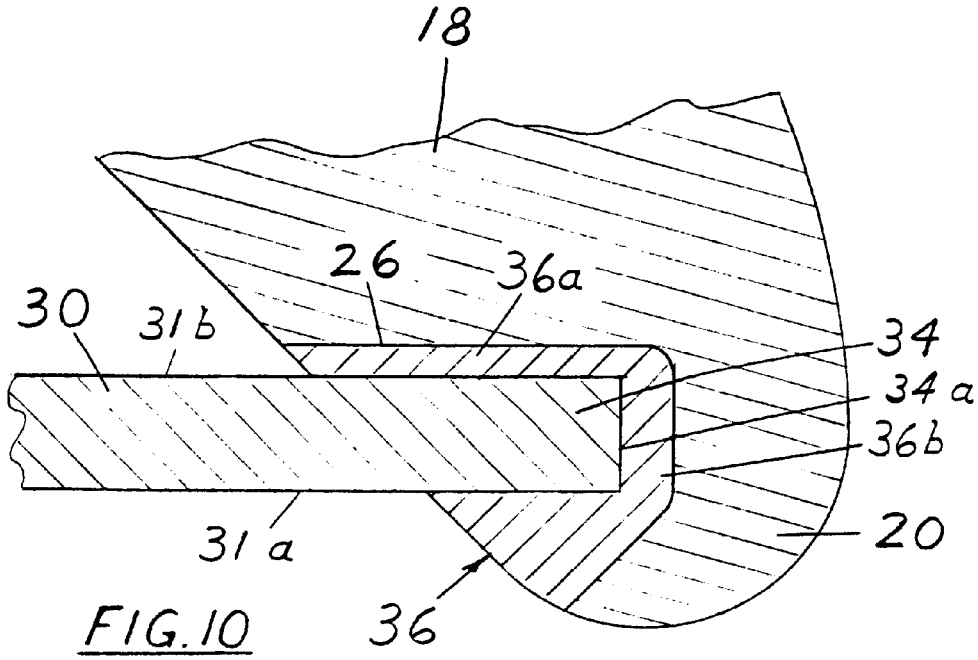
FIG. 10 is a section along the line 10—10 of FIG. 7.

Each end 34 of the beam is held in place in its cavity by embedment in a suitable bonding material 36. In this case metal filled epoxy synthetic material is used, as being a solid space filling material of great strength. The epoxy indicated as 36 (FIG. 10) fills each cavity and bonds to back surfaces 31*b* of the beam and also to the top and bottom edge surfaces 32*a*–32*b*, in the region of notches 32, and end edge surfaces 34*a* at each end 34 of beam 30. The beam 30 between its ends 34 extends across the open V-shaped or generally triangular space 22 formed between arms 20 and is unsupported, except at its two ends 34. It is thus free to perform as a true planar beam in engineering terms without any additional support or strengthening . The reduced width ends 34—34 being fully enveloped on their rear surfaces 31*b*, and also on the end edges 34*a*, and on their top and bottom edge surfaces 32*a*–32*b* are secured and restrained against rotational freedom. The plastic epoxy embedment material also provides a shock absorbing damping function. This is important to the stated objects of the invention which are to provide a striking surface having the flex characteristics of a planar beam.

The engineering principles applying to the characteristics of a semi-fixed beam unsupported along the edges, are known and predictable . By describing the beam as "unsupported" it is intended to imply that the beam is unsupported along its length but is of course supported at its two ends.

When such a beam is subjected to stress between its ends, it is known that it will deflect to a greater or lesser degree. The amount of deflection will depend on various factors, eg, the material, the thickness, the length, and the level of stress, amongst others. However even when relatively short, as in the present case some deflection does occur.

This has significant results in the performance of the club. It assists the player in maintaining accurate direction of the ball. Also, due to the energy dissipation characteristics of the system, it tends to reduce the twisting or rotation of the shaft in the hands of the player.

Finally, the beam and the triangular or V-shaped space behind it, and the wooden body combine together to provide a distinctive sound when the ball is struck. This sound will vary somewhat depending upon whether to ball is struck dead center along the beam or whether it is off center. As the player becomes more proficient with the club, he will find it easier to align the ball at the dead center point, and produce the correct sound.

In order to assist in alignment of the putter with the intended path of the ball, a linear, V-shaped groove 38 is formed along the central axis of the top of the body, and a corresponding groove 38 is formed in the center of the top edge of the beam 30. These sight lines, due to the size and extent of the top surface of the club, are of greater length than sight lines on conventional putters giving the player an extra advantage. When utilized properly, and the sight groove aligned to the target, the ball upon striking will be sent in a direction that is perpendicular to the face of the blade thus providing the desired results. The sight lines are more generous in length than on other putters, because of the combination of the blade and the head space. This will provide the player with a more accurate and easily alignable feature when setting up for the put.

Reference may now be made to the shaft indicated generally as 14. The lower end 40 of the shaft 14 is received in an angled bore 42 of head 12. Bore 42 is preferably angled at about 10 deg from the perpendicular, to suit the majority of players.

Figure 3:
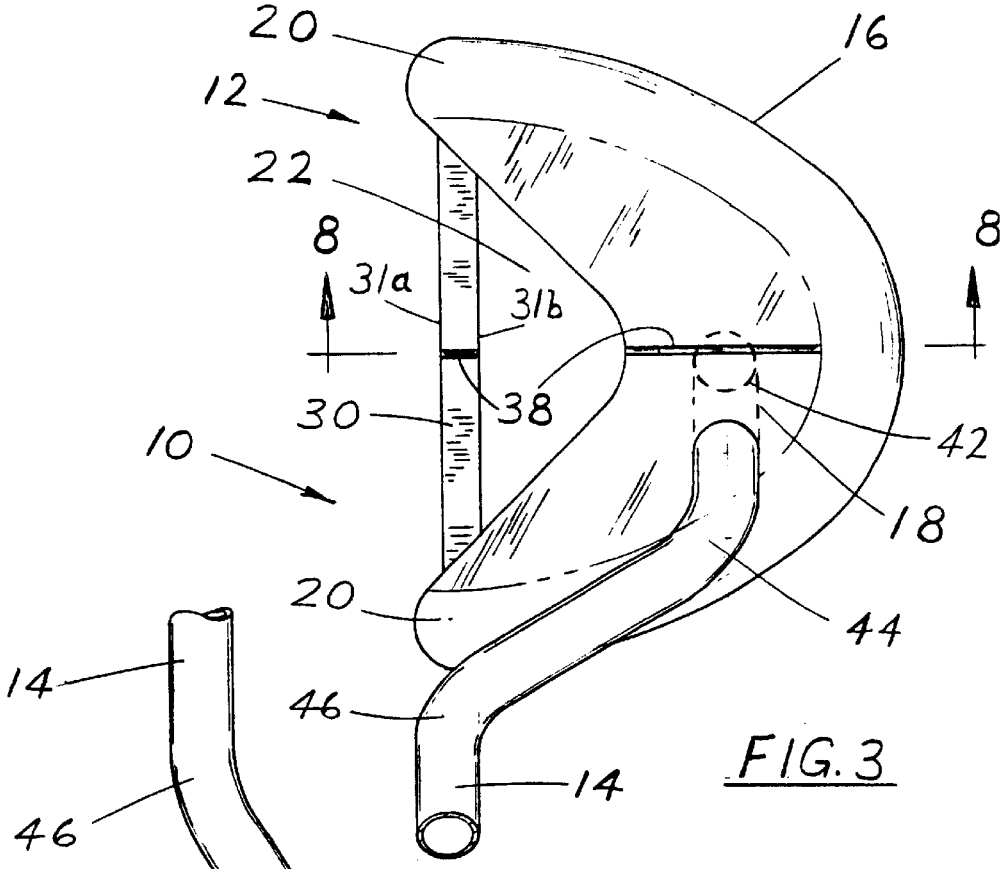
FIG. 3 is a top plan of the club head.
Figure 4:
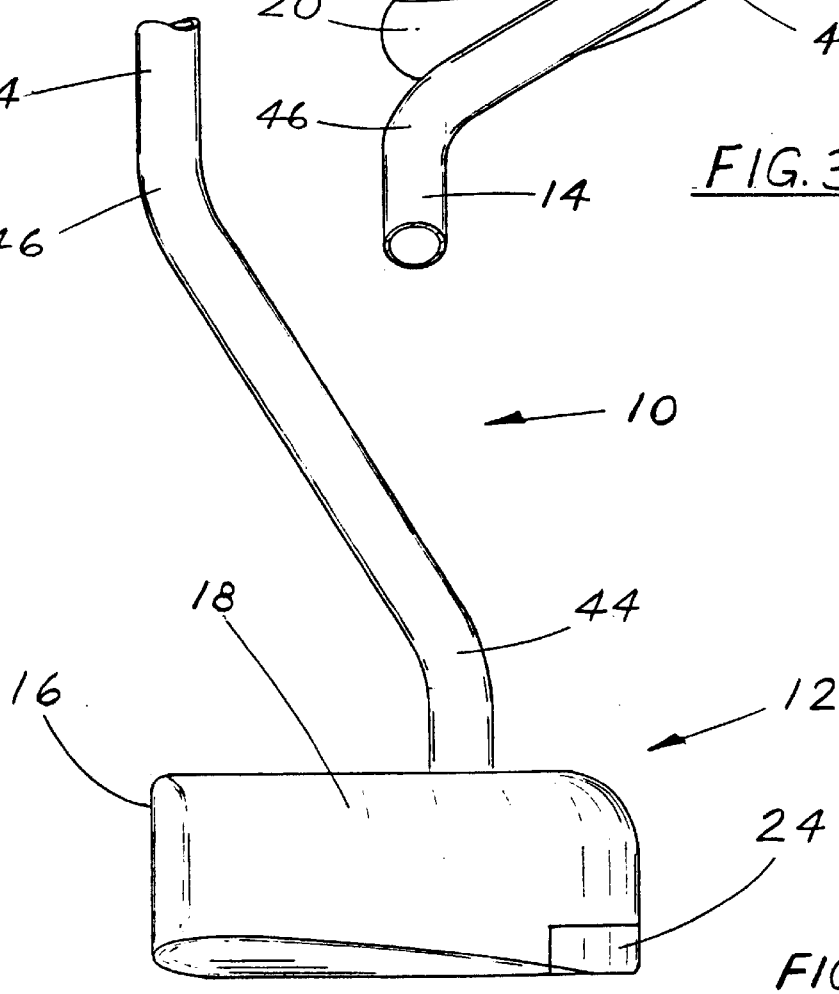
FIG. 4 is a side elevation of the club head.
Figure 5:
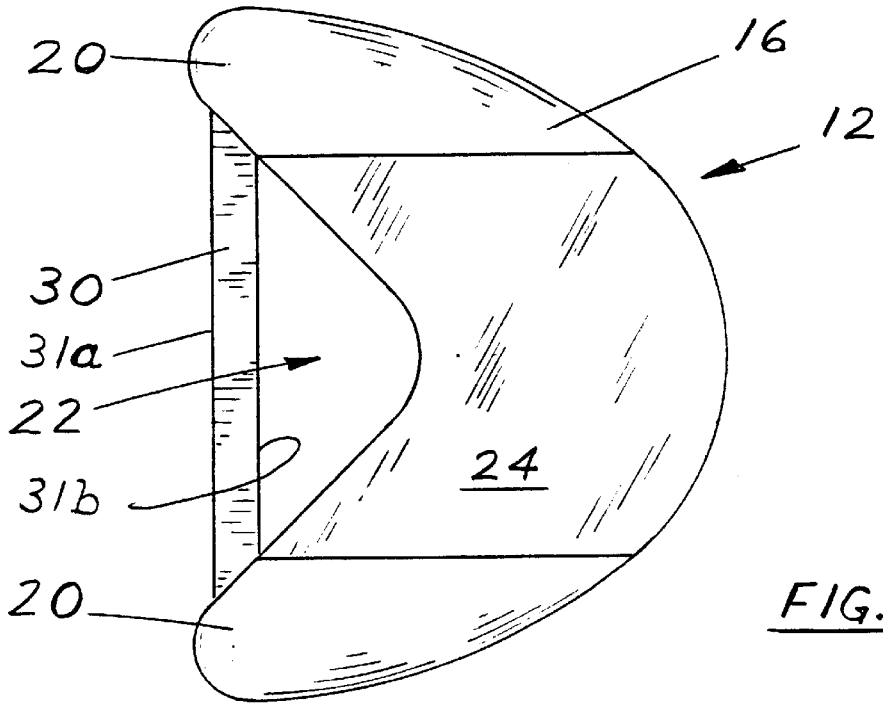
FIG. 5 is a bottom plan of the club head.
Figure 6:
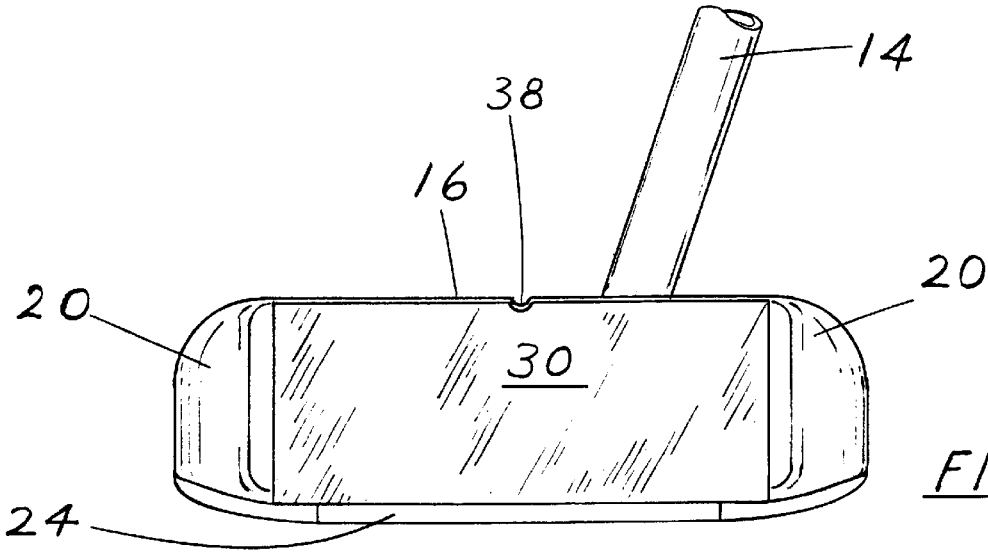
FIG. 6 is a front elevation of the club head.

The lower end of bore 42 (phantom in FIG. 3) is centered on the central axis of the body 12 while the bore itself is angled so as to permit the shaft to extend to one side of the body 12, in the usual manner.

The shaft is formed with first and second offset bends 44 and 46. These two bends form a double offset which positions the shaft in alignment with the front face of beam 30 thus producing a face balanced putter design. This arrangement further assist in reducing twisting of the shaft if the ball is struck off center on the beam.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A golf club comprising;

a club body defining a main body portion and two side arm portions formed integrally therewith and extending forwardly of said main body portion, and said side arm portions defining forwardly extending free ends, said side arm portions and said main body portion defining a space forwadly of said main body portion and between said side arm portions;

a flat planar metallic beam defining two ends forming a striking face made of said metallic beam;

notches formed at said two ends of said beam defining reduced width beam end portions, said reduced width beam end portions defining rear planar surfaces, end edge surfaces and top and bottom edge surfaces;

cavities formed at said two forwardly extending free ends of said two side arm portions said reduced width end portions of the beam being received in said two cavities; and, bonding material in respective said cavities, enveloping said rear planar surfaces and said end edge surfaces and said top and bottom edge surfaces of each of said reduced width beam end portions of said beam and securing said beam end portions in said cavities on respective side arm portions of said club body, wherein the length of said beam between the two free ends of said side arm portions extends across said space between said two free ends of said side arm portions and is unsupported.

2. A golf club as claimed in claim 1 wherein said beam behaves with the engineering characteristics of a true beam, and will flex where it is unsupported between its two ends, upon impact with the ball.

3. A golf club as claimed in claim 1 wherein said beam is a bronze blade.

4. A golf club as claimed in claim 3 wherein said ends of said beam are bonded in said cavities with metal epoxy to provide semi-fixed beam characteristics.

5. A golf club as claimed in claim 4, wherein said main body and said side arm portions define a generally crescent shape, in plan .

6. A golf club as claimed in claim 3 wherein the main body portion and said two side arm portions define a generally triangular shaped space between the beam and the body.

7. A golf club as claimed in claim 6 wherein the club body acts as a sounding box when the ball is struck, whereby when the ball is struck the club develops a distinctive sound.

8. A golf club as claimed in claim 7 and including a metallic sole plate on the underside of said body to provide weight at the bottom of the body thereby lowering the center of gravity for optimized blade to ball contact.

9. A golf club as claimed in claim 8 wherein said beam defines a lower edge, and said lower edge is positioned in a plane above the plane of the sole plate on the underside of the body whereby to prevent said beam from contacting the playing surface as the club moves through a swing arc of a stroke.

10. A golf club as claimed in claim 1 wherein said club body is attached to a shaft, and including a double offset bend in said shaft having the effect of lining up the central axis of the shaft with the striking face of the club, thereby achieving a face balanced design.

11. A golf club as claimed in claim 1 including angular profiles provided around areas of the undersurface of the body to permit ground clearance, with a central area being substantially flat.

12. A golf club as claimed in claim 11 wherein the upper surface of the body is flat and parallel with flat portions of the undersurface.

13. A golf club as claimed in claim 12 and including a ball to target visual alignment means extending from across the top surface of the beam and the upper surface of the body.

14. A golf club as claimed in claim 13 wherein the visual alignment means is in the form of a linear groove.

* * * * *